US012091920B2

(12) United States Patent
Eitschberger et al.

(10) Patent No.: US 12,091,920 B2
(45) **Date of Patent: *Sep. 17, 2024**

(54) WEIGHT MODULE FOR USE IN WELLBORE TOOL STRING

(71) Applicant: DynaEnergetics Europe GmbH, Troisdorf (DE)

(72) Inventors: Christian Eitschberger, Munich (DE); Thilo Scharf, Donegal (IE)

(73) Assignee: DynaEnergetics Europe GmbH, Troisdorf (DE)

( * ) Notice: Subject to any disclaimer, the term of this patent is extended or adjusted under 35 U.S.C. 154(b) by 0 days.

This patent is subject to a terminal disclaimer.

(21) Appl. No.: 18/302,471

(22) Filed: Apr. 18, 2023

(65) Prior Publication Data

US 2023/0272677 A1 Aug. 31, 2023

Related U.S. Application Data

(63) Continuation of application No. 17/700,024, filed on Mar. 21, 2022, now Pat. No. 11,668,137, which is a continuation of application No. 17/363,876, filed on Jun. 30, 2021, now Pat. No. 11,313,180.

(60) Provisional application No. 63/168,676, filed on Mar. 31, 2021.

(51) Int. Cl.
*E21B 17/02* (2006.01)
*E21B 17/10* (2006.01)

(52) U.S. Cl.
CPC ..... *E21B 17/0285* (2020.05); *E21B 17/028* (2013.01); *E21B 17/10* (2013.01)

(58) Field of Classification Search
CPC ..... E21B 17/028; E21B 17/0285
See application file for complete search history.

(56) References Cited

U.S. PATENT DOCUMENTS 2,092,337 A 9/1937 Spencer et al.
6,968,903 B2 11/2005 Pollard
8,186,259 B2 5/2012 Burleson et al.
(Continued)

FOREIGN PATENT DOCUMENTS

CN 205689137 U 11/2016

OTHER PUBLICATIONS

Hunting Energy Services; Sinker Bars/Eccentered Weights; 2014; http://www.hunting-intl.com/media/1969504/SinkerBarsEccenteredWeights.pdf; 5 pages.

*Primary Examiner* — Giovanna Wright
(74) *Attorney, Agent, or Firm* — Womble Bond Dickinson (US) LLP

(57) ABSTRACT

Disclosed embodiments relate to weight modules for use in a wellbore tool string. In some embodiments, the weight module may comprise a conductive body, extending in an axial direction, and an insulating cover. The conductive body may be configured to fit within a hollow interior of a weight module housing, and the insulating cover may be configured to electrically isolate the conductive body from the weight module housing. In some embodiments, the conductive body may have a first contact portion, provided at a first end of the conductive body, and a second contact portion, provided at a second end of the conductive body, with the first contact portion in electrical communication with the second contact portion through the conductive body.

20 Claims, 6 Drawing Sheets

(56) References Cited

U.S. PATENT DOCUMENTS

| | | | |
|---|---|---|---|
| 9,273,528 | B2 | 3/2016 | Cooper |
| 9,459,371 | B1 | 10/2016 | Holmen et al. |
| 10,024,118 | B2 | 7/2018 | Stolt et al. |
| 10,120,094 | B2 | 11/2018 | Jaaskelainen et al. |
| 10,494,916 | B2 | 12/2019 | White et al. |
| 11,313,180 | B1 * | 4/2022 | Eitschberger ..... E21B 43/128 |
| 2005/0067169 | A1 | 3/2005 | Wills |
| 2019/0040685 | A1 | 2/2019 | Moeny |

* cited by examiner

WEIGHT MODULE FOR USE IN WELLBORE TOOL STRING

CROSS-REFERENCE TO RELATED APPLICATIONS

This application is a continuation of and claims priority to U.S. patent application Ser. No. 17/700,024 filed Mar. 21, 2022, which is a continuation of and claims priority to U.S. patent application Ser. No. 17/363,876 filed Jun. 30, 2021, which claims the benefit of U.S. Provisional Patent Application No. 63/168,676 filed Mar. 31, 2021. The entire contents of each of the applications listed above are incorporated herein by reference.

BACKGROUND

Hydrocarbon extraction may include inserting or pumping down a tool string into a wellbore. There may be significant pressure in the wellbore head that may act against the insertion of the tool string. Weight bars or sinker bars may be used to add additional weight to the tool string to facilitate insertion against the wellbore head pressure. Increasing weight of the tool string may allow gravitational forces to balance or overcome the wellbore head pressure.

However, conventional weight bars may be limited in that they are typically mounted on top of the tool string or on top of a cable head on the cable. It may be desirable to develop a weight module that may be used at any position along the tool string. Additionally, it may be desirable to develop a weight module that can be used to align a tool string to a desired orientation within the wellbore. In some embodiments, it may be desirable to develop a weight module that can allow passage of electrical signals to other elements of the wellbore tool string without the need for external wired electrical connections.

BRIEF DESCRIPTION OF THE EXEMPLARY EMBODIMENTS

According to an aspect, the exemplary embodiments include a weight module for use in a wellbore tool string. In some embodiments, the weight module may comprise a conductive body, extending in an axial direction, and an insulating cover covering an outer radial surface of the conductive body. In some embodiments, the conductive body may be configured to fit within a hollow interior of a weight module housing, and the insulating cover may be configured to electrically isolate the conductive body from the weight module housing. The conductive body may have a first contact portion provided at a first end of the conductive body and a second contact portion provided at a second end of the conductive body, opposite the first end in the axial direction. In some embodiments, the first contact portion may be in electrical communication with the second contact portion through the conductive body.

In another aspect, the exemplary embodiments include a wellbore tool string. In some embodiments, the wellbore tool string comprises a weight module housing and a weight module. In some embodiments, the weight module housing may include a hollow interior, and may extend in an axial direction. In some embodiments, the weight module may be disposed within the hollow interior of the weight module housing. The weight module may comprise a conductive body, extending in an axial direction, and an insulating cover covering an outer radial surface of the conductive body. The conductive body may have a first contact portion provided at a first end of the conductive body and a second contact portion provided at a second end of the conductive body, opposite the first end in the axial direction. In some embodiments, the first contact portion may be in electrical communication with the second contact portion through the conductive body.

BRIEF DESCRIPTION OF THE DRAWINGS

A more particular description will be rendered by reference to exemplary embodiments that are illustrated in the accompanying figures. Understanding that these drawings depict exemplary embodiments and do not limit the scope of this disclosure, the exemplary embodiments will be described and explained with additional specificity and detail through the use of the accompanying drawings in which.

Figure 1:
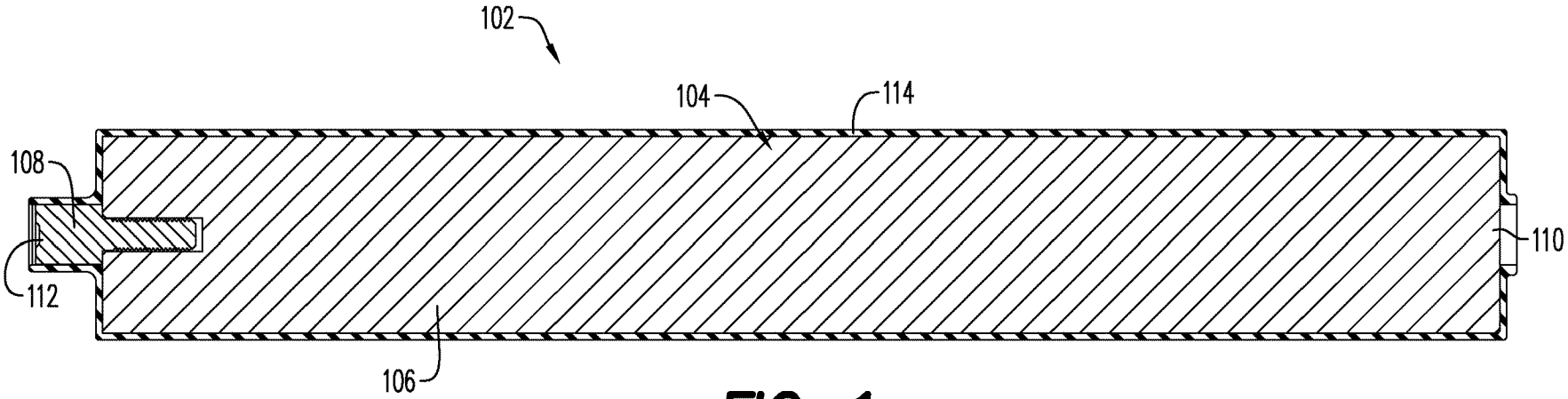
FIG. 1 is a cross-sectional view of a weight module according to an exemplary embodiment.

Various features, aspects, and advantages of the exemplary embodiments will become more apparent from the following detailed description, along with the accompanying drawings in which like numerals represent like components throughout the figures and detailed description. The various described features are not necessarily drawn to scale in the drawings but are drawn to aid in understanding the features of the exemplary embodiments.

The headings used herein are for organizational purposes only and are not meant to limit the scope of the disclosure or the claims. To facilitate understanding, reference numerals have been used, where possible, to designate like elements common to the figures.

DETAILED DESCRIPTION

Reference will now be made in detail to various exemplary embodiments. Each example is provided by way of explanation and is not meant as a limitation and does not constitute a definition of all possible embodiments. It is understood that reference to a particular "exemplary embodiment" of, e.g., a structure, assembly, component, configuration, method, etc. includes exemplary embodiments of, e.g., the associated features, subcomponents, method steps, etc. forming a part of the "exemplary embodiment".

For purposes of this disclosure, the phrases "devices," "systems," and "methods" may be used either individually or in any combination referring without limitation to disclosed components, grouping, arrangements, steps, functions, or processes.

An exemplary embodiment will now be introduced according to FIG. 1. The exemplary embodiment according to FIG. 1 is illustrative and not limiting, and exemplary features may be referenced throughout this disclosure. FIG.

Figure 2:
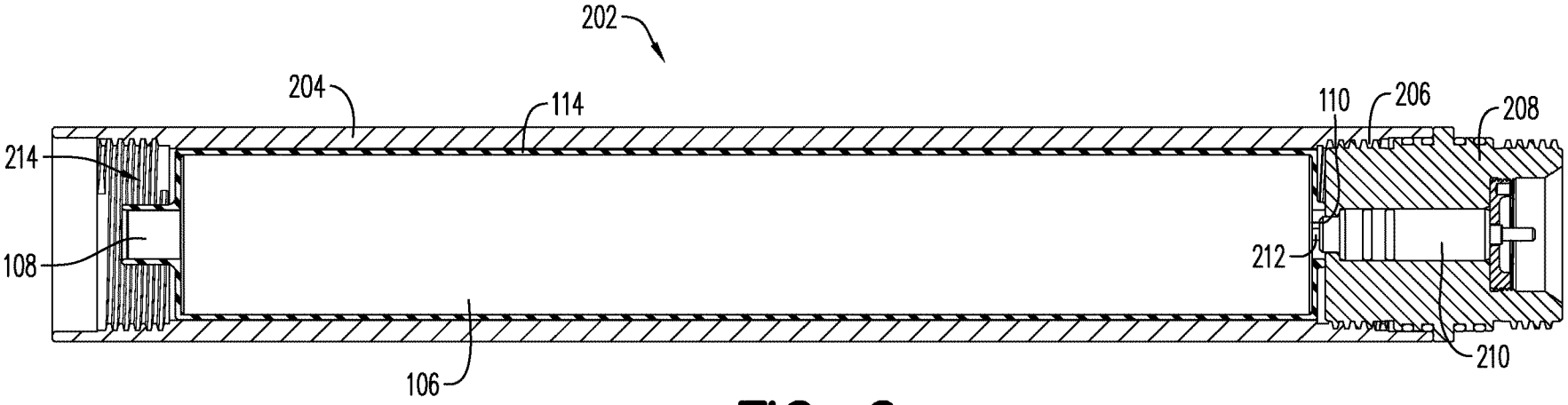
FIG. 2 is a cross-sectional view of a weight module assembly according to an exemplary embodiment.

1 shows a weight module 102 according to an exemplary embodiment. The weight module 102 may include a conductive body 104 and an insulating cover 114 covering at least a portion of an outer radial surface of the conductive body 104. The conductive body 104 may be configured to fit within a hollow interior of a weight module housing 204 (for example, as shown in FIG. 2), and the insulating cover 114 may be configured to electrically isolate the conductive body 104 from the weight module housing 204 when the weight module 102 is disposed within the weight module housing 204. In some embodiments, substantially the entire outer radial surface of the conductive body 104 may be covered by the insulating cover 114. In some embodiments, the weight module 102 may be configured with a radial offset between the conductive body 104 and the weight module housing 204, which may be provided by the insulating cover 114 in some embodiments.

Typically, at least a portion of the conductive body 104, for example both ends of the conductive body 104, may be uncovered by the insulating cover 114, for example to provide electrical contact locations configured to allow electrical signals to pass through the conductive body 104. For example, the conductive body 104 may include a first contact portion 110 provided at a first end of the conductive body 104 in the axial direction, and a second contact portion 112 provided at a second end of the conductive body 104 in the axial direction (e.g. opposite the first end). In some embodiments, the first contact portion 110 and the second contact portion 112 may be formed by portions of the conductive body 104 that are uncovered by the insulating cover 114. The first contact portion 110 may be in electrical communication with the second contact portion 112 by virtue of the electrical conductivity of the conductive body 104.

As seen in FIG. 1, the conductive body 104 may extend in an axial direction and comprise a main body 106 and a rod piece 108. In some embodiments, the main body 106 may be symmetrical about a longitudinal axis, for example, cylindrical. In some embodiments, the weight module 102 may have a center of gravity aligned or approximately aligned with the longitudinal axis. In some embodiments, the rod piece 108 may be connected to (e.g. physically attached to) and/or in electrical communication with the main body 106. In some embodiments, the rod piece 108 may form the second contact portion 112. In some embodiments, the rod piece 108 may be configured for electrical coupling or communication with a tandem seal adapter (TSA) (e.g. when the TSA is coupled to the weight module housing 204). The rod piece 108 may extend outward from the main body 106, for example axially. In some embodiments, the rod piece 108 may be configured to be disposed along a central axis 406 (see for example, FIG. 4) of a weight module housing 204, for example when the weight module 102 is disposed within the weight module housing 204. In some embodiments, the rod piece 108 may be inserted into an end of the main body 106. However, it will be understood that the disclosure is not limited to this embodiment. In some embodiments, the conductive body 104 may comprise a second rod piece (not shown), which may extend outward from the main body 106 (e.g. opposite the first rod piece 108). In some embodiments, the second rod piece may be inserted into the main body 106 opposite the rod piece 108. In some embodiments, the second rod piece may form the first contact portion 110. The rod piece 108 may be connected to and/or in electrical communication with the second rod piece. In some embodiments (e.g. without a second rod piece), the first contact portion 110 may be substantially flush with the end of the main body 106 opposite the rod piece 108, for example as shown in FIG. 1, and/or may be in electrical communication with the rod piece 108 through the main body 106. In some embodiments, the first contact portion 110 may be formed by an opening in the insulating cover 114 on the axial end of the main body.

Alternatively, an exemplary embodiment of the conductive body 104 may be formed of a singular, monolithic piece of material. For example, the rod piece 108 and the main body 106 may be integrally formed (e.g. as a solid piece of material which is shaped to have a main body 106 and one or more rod pieces). In some embodiments, the conductive body 104 may be a solid piece of high-density, electrically conductive material, which may be formed to have a main body 106 and one or more rod pieces. In some embodiments, the conductive body 104 or the weight module 102 may not have any significant or substantial voids, cavities, or openings, but may be a solid form. For example, the conductive body 104 of FIGS. 1-3 may be a solid cylinder.

Both the main body 106 and the rod piece 108 may be formed of an electrically conductive material. Additionally, one or both of the main body 106 and the rod piece 108 may comprise, consist essentially of, or be formed of a high-density material. For example, the high-density material may be a high-density, electrically conductive material which is at least as dense as steel. In some embodiments, the high-density material may be a high-density, electrically conductive material which is denser than steel, at least as dense as tungsten, or at least as dense as lead. In some embodiments, the density of the high-density material may range from 7,750 kg/m3 (i.e. 484 lb/cu ft or 7.75 g/cm3 or 4.48 oz/cu in) to 19300 kg/m3 (i.e. 1210 lb/cu ft or 19.3 g/cm3 or 11.1272 oz/cu in). In some embodiments, the conductivity of the high-density material may range from 1.43×10–7 S/m at 20° C. Conductivity to 4.55×10 6 S/m at 20° C. Conductivity.

As an example, the main body 106 and the rod piece 108 may comprise, consist essentially of, or be formed of one of the following: tungsten, lead, steel, and combinations thereof. However, it will be understood that the disclosure is not limited to these materials and that other dense, electrically conductive materials may also be used. In some embodiments, the main body 106 may comprise, consist essentially of, or be formed of high-density conductive material (e.g. as described above), while the rod piece 108 may comprise, consist essentially of, or be formed of a conductive material that is not high-density (e.g. less dense than steel or having a density less than 7,750 kg/m3). In some embodiments, the main body 106 may be higher density than the rod piece 108 and/or the rod piece 108 may be more electrically conductive than the main body 106. For example, the rod piece 108 may comprise, consist essentially of, or be formed of a material that is more conductive than the main body 106, such as aluminum or brass.

The insulating cover 114 may be formed of an electrically insulating material and may cover the outer radial surface of the conductive body 104 (e.g. the main body 106 and/or the one or more rod piece 108). The insulating cover 114 may leave openings at the axial ends of the conductive body 104, i.e., corresponding to the first contact portion 110 and the second contact portion 112, so that electrical contact can be made with these portions by other structures or elements in the tool string. Typically, the insulating cover 114 would be sufficiently insulating to electrically isolate the conductive body 104 from the weight module housing 204 when the weight module 102 is disposed within the weight module housing 204. In some embodiments, the insulating cover 114 may be formed of a material which qualifies as an insulating material. The insulating cover 114 may be formed of a material which is significantly less electrically conductive and/or significantly more electrically resistive than the conductive body 104 and/or the weight module housing 204 (e.g. compared to steel, lead, or tungsten). By way of example, the insulating cover 114 may comprise or consist essentially of electrically insulating material applied to the outer radial surface of the conductive body, for example by dipping, lacquering, powder coating, or painting. In some embodiments, the insulation resistance of the electrically insulating material should be approximately (or in some embodiments, at least) one megohm for each 1,000 volts of operating voltage, with a minimum value of one megohm. For example, in a system which is functioning at low voltage (e.g. at approximately 30V), the insulation resistance of the insulating material may have a minimum of one megohm.

While many embodiments may have a conductive body 104 which is significantly denser than the insulating cover 114, in alternative embodiments, the insulating cover 114 may have a density which is comparable to or greater than the density of the conductive body 104. For example, the insulating cover 114 may comprise a high-density, electrically insulating material. In some such embodiments, the conductive body 104 may not have a high density, and the weight of the weight module 102 may primarily result from the high-density insulating cover 114. For example, the conductive body 104 may be relatively thin compared to the insulating cover 114 in such embodiments, with the main body 106 diameter being approximately the same or only slightly larger than the rod piece 108.

In some embodiments, the weight module 102 may be at least or approximately 30 Kg. In some embodiments, the weight module 102 may have a length of at least or approximately 20 inches (e.g. 51 cm). In some embodiments, the weight module 102 may be configured to be disposed within a weight module housing 204 (e.g. within a hollow interior of the weight module housing 204, as shown in FIG. 2). For example, the weight module 102 may be configured to be removably disposed within the weight module housing 204.

Figure 3:
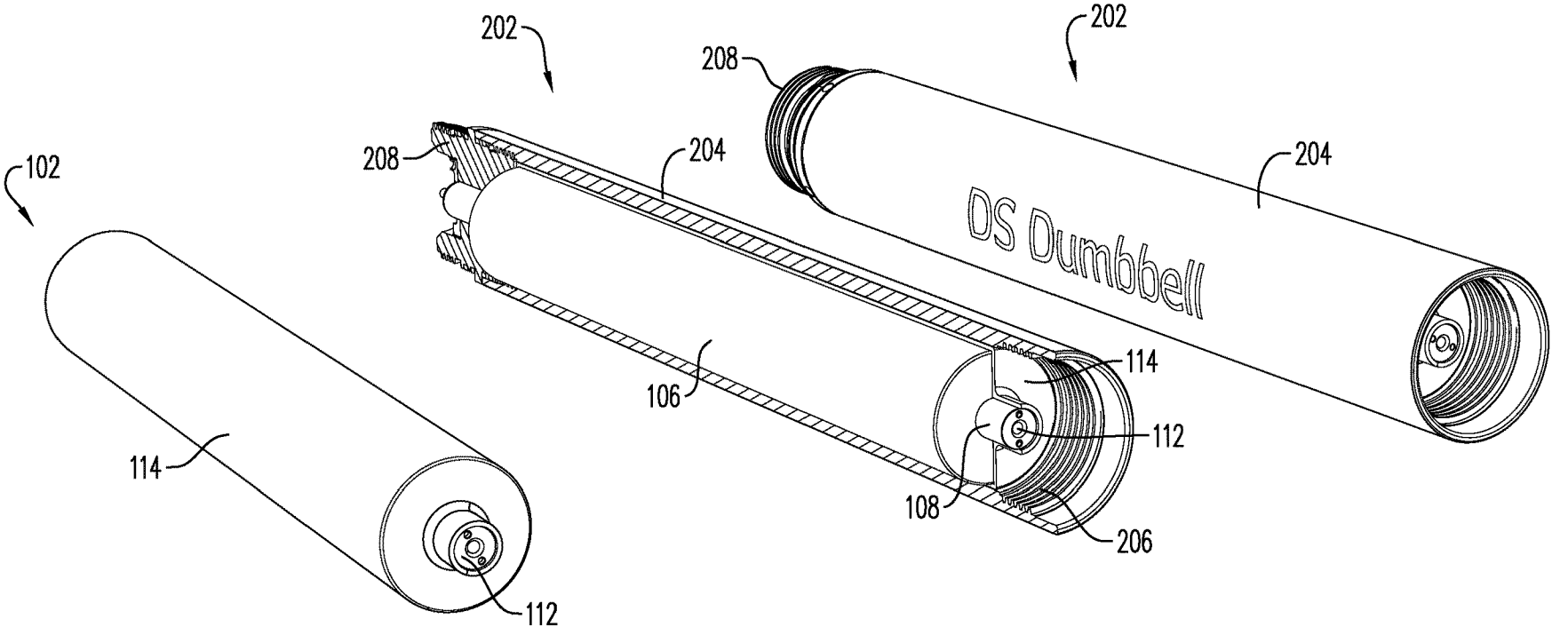
FIG. 3 shows perspective and cutaway views of weight module and weight module assemblies according to an exemplary embodiment.

An exemplary embodiment will now be introduced according to FIGS. 2-3. The exemplary embodiment according to FIGS. 2-3 is illustrative and not limiting, and exemplary features may be referenced throughout this disclosure. FIG. 2 illustrates a weight module assembly 202, having a weight module 102 disposed within a weight module housing 204. The weight module assembly 202 may be part of a larger tool string (see for example FIG. 7) that may include one or more perforating guns. In some embodiments, the weight module 102 may be housed within a perforating gun carrier/barrel. For example, the weight module housing 204 may be part of a perforating gun carrier/barrel. The weight module housing 204 may be configured to be removable or releasable from the weight module 102, for example allowing the weight module 102 to be reused within different weight module housings. This may allow reuse of the weight module 102, even if the weight module housing 204 is damaged, for example, during wellbore operations. The weight module housing 204 may comprise a hollow interior, having a central axis 406, which is configured to receive the weight module 102 (for example via sliding of the weight module 102 into the hollow interior of the weight module housing 204).

In some embodiments, the weight module housing 204 may comprise two open ends, and the hollow interior may form a cavity extending longitudinally between the two open ends. For example, the weight module housing 204 may comprise a hollow cylinder. In some embodiments, the weight module housing 204 may comprise an outer diameter similar to other tools configured for use in the wellbore tool string and/or configured to allow insertion into a wellbore. In some embodiments, the weight module housing 204 may have an inner diameter sufficiently large to encompass the weight module 102. While the weight module 102 often is removably or releasably disposed without attachment within the weight module housing 204, in other embodiments, the weight module 102 may be (e.g. removably) attached to the weight module housing 204. In some embodiments, the weight module housing 204 may comprise one or more coupling elements (e.g. threads) on each end, which may be configured to allow attachment of the weight module housing 204 to a TSA, perforation gun, or other tool element within the tool string. For example, the weight module housing 204 may include internal weight module housing threads 206 provided on an inner surface of the weight module housing 204. In some embodiments, the weight module housing 204 may be configured to allow for attachment of the weight module 102 anywhere within the tool string.

In some embodiments, the conductive body 104 and/or main body 106 may be substantially cylindrical and/or symmetrical about the central axis 406 of the housing or a longitudinal axis of the conductive body 104. For example, the longitudinal axis of the main body 106 or conductive body 104 may be aligned with and/or parallel to the central axis 406 of the weight module housing 204 when the weight module 102 is disposed within the weight module housing 204. In some embodiments, the rod piece 108 may extend outward from the main body 106 along the central axis 406 or longitudinal axis. Typically, the outer diameter of the main body 106 is configured to be less than the inner diameter of the weight module housing 204. In some embodiments, the gap between the main body 106 and the inner diameter surface of the weight module housing 204 may be approximately the thickness of the insulating cover 114 (e.g. so that the insulating cover 114 contacts the interior of the weight module housing 204 when the weight module 102 is disposed within the weight module housing 204), although in other embodiments the gap may be sufficiently large so that the insulating cover 114 does not contact the inner diameter surface of the weight module housing 204. In some embodiments, the weight module 102 substantially fills the hollow interior of the weight module housing 204.

In some embodiments, the weight module assembly 202 may further include a tandem seal adapter (TSA) 208 coupled to a first end of the weight module housing 204, for example via the internal weight module housing threads 206. The TSA 208 may be configured to allow for both physical and electrical coupling of two elements of a wellbore tool string, for example, with the TSA 208 therebetween. The TSA 208 may include an electrical feedthrough assembly 210 having a first electrical contact 212 at one end and a second electrical contact (see for example the second electrical contact 712 of FIG. 7) on the opposite end. The first electrical contact 212 may be in electrical communication with the second electrical contact 712 of the TSA 208, for example when the TSA 208 is coupled between two elements of the tool string, to allow electrical signals to pass through the TSA 208. The first electrical contact 212 of the TSA 208 may be in electrical contact with the first contact portion 110 of the weight module 102. In an exemplary embodiment, the electrical contact between the first electrical contact 212 and the first contact portion 110 may be wireless or wire-free, i.e., the connection is made by direct physical contact between conductive elements (such as between the first electrical contact 212 of the TSA 208 and the first contact portion 110 of the conductive body 104), without the use of wires. For purposes of this disclosure, "wireless electrical connection" means an electrical connection formed by physical contact between conductive components, without any wires electrically connecting the conductive components. "Electrical contact" means either a conductive component for making a wireless electrical connection, or a state of physical, conductive contact between conductive components, as the context makes clear.

In some embodiments, the first electrical contact 212 and/or the second electrical connect 712 of the TSA 208 may be biased (e.g. spring loaded) so as to rest at a rest position if no external force is applied, but to move to a retracted position in response to application of external force upon the electrical contact (for example when the TSA 208 is coupled to an element of the tool string, such as the weight module 102). In some embodiments, movement between the rest position and the retracted position is axial and/or may be configured to be parallel to and/or aligned with the central axis 406 of the weight module housing 204 when connected in a tool string. In some embodiments, the first electrical contact 212 and the second electrical contact 712 may only become electrically coupled through the TSA 208 in the retracted position. For example, in the retracted position the first electrical contact 212 and the second electrical contact 712 of the TSA 208 may be electrically coupled without wiring, for example by direct contact conduction, and may thereby provide for feedthrough of electrical signals through the TSA 208. Some embodiments of the TSA 208 may further include one or more seals configured to seal adjacent elements of the tool string upon connection (e.g. to form a sealed connection therebetween). Further description of exemplary embodiments of the TSA 208 and/or electrical feedthrough assembly 210 may be found in U.S. application Ser. No. 16/819,270 filed Mar. 16, 2020, which is hereby incorporated by reference in its entirety to the extent that it is consistent and/or compatible with this disclosure.

In some embodiments, the weight module 102 may be removably or releasably disposed within the weight module housing 204. In some embodiments, the weight module 102 may slide freely into the weight module housing 204 and be disposed therein without direct physical attachment to the weight module housing 204. For example, the weight module 102 may be held in place within the weight module housing 204 only by having elements (such as TSA 208) of the tool string attached at both ends of the weight module housing 204 to close the open ends. For example, a TSA 208 may abut each end of the conductive body 104. The TSA 208 may be fixed with respect to the weight module housing 204 (e.g. by engagement of complementary threads), so that abutment of the TSA 208 and the weight module 102 retains the weight module 102 within the weight module housing 204 (e.g. preventing the weight module 102 from sliding out of the open end of the weight module housing 204). In such instances, the weight module 102 may be removed from the weight module housing 204 by removing (e.g. unscrewing) the TSA 208 and sliding the weight module 102 out of the weight module housing 204 through the open end of the weight module housing 204.

Further, as the electrical feedthrough assembly 210 of the TSA 208 is connected to the first electrical contact 212, the conductivity of the conductive body 104 allows the weight module 102 to feed through any control signals sent down the tool string without interruption and/or without the need for separate wiring. The insulating cover 114 prevents the conductive body 104 from being shorted to the weight module housing 204. In other words, this may provide modularity to the weight module housing 204 so that it may be interchangeable with any other tool in the tool string. This may allow a user to place the weight module 102 at any desired position within the tool string, instead of just being limited to the top of the string or above the cable head, and the conductivity of the conductive body 104 allows electrical control signals to pass through to other components in the tool string without interruption. Additionally, multiple weight module assemblies 202 may be easily strung together via TSAs to achieve a larger weight.

In an exemplary embodiment, the weight module housing 204 may have approximately or substantially the same size and shape as other tools, such as perforating gun assemblies, within the tool string. For example, the weight module housing 204 may have an outer diameter such as 2.75 inches, 3.125 inches, 3.5 inches, etc. as are typically used for perforating gun assemblies. In some embodiments, the inner diameter of the weight module housing 204 may be approximately or substantially the same as that of a perforating gun housing 704 (see FIG. 7) or other housing used within the tool string. Additionally, the internal weight module housing threads 206 of the weight module housing 204 may be approximately or substantially identical to the internal perforating gun threads of the perforating gun housings in the tool string. Some embodiments of the weight module housing may have internal weight module housing threads disposed at both ends of the housing (e.g. including second internal weight module housing threads 214 at the end opposite the internal weight module housing threads 206). In some embodiments, a common, uniform housing may be used for multiple elements within the tool string. For example, the weight module housing 204 and the perforation gun housing may be identical (e.g. common, uniform housings). In some embodiments, the weight module housing 204 may be symmetrical about the central axis 406 and about an axis perpendicular to the central axis 406. For example, both ends of the weight module housing 204 may be identical, allowing either end of the weight module housing 204 to be used interchangeably.

FIG. 3 shows additional perspective and cutaway views of the weight module 102 and the weight module assembly 202.

Figure 4:
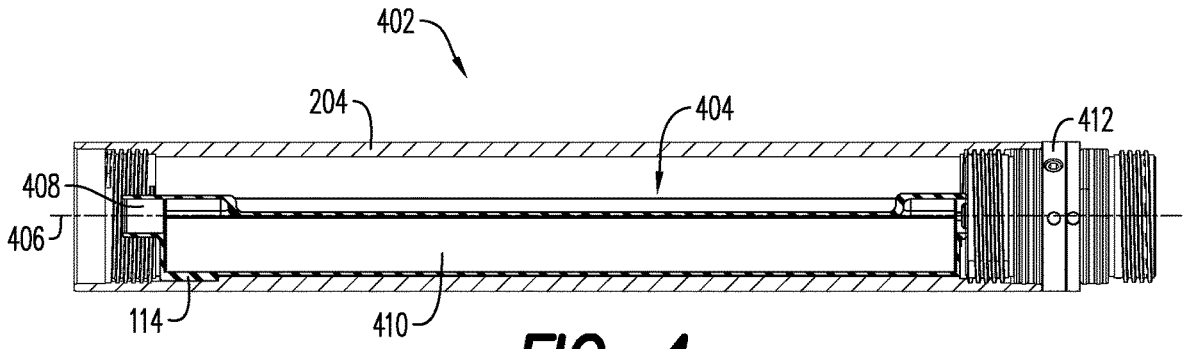
FIG. 4 is a cross-sectional view of a weight module assembly according to an exemplary embodiment.
Figure 5:
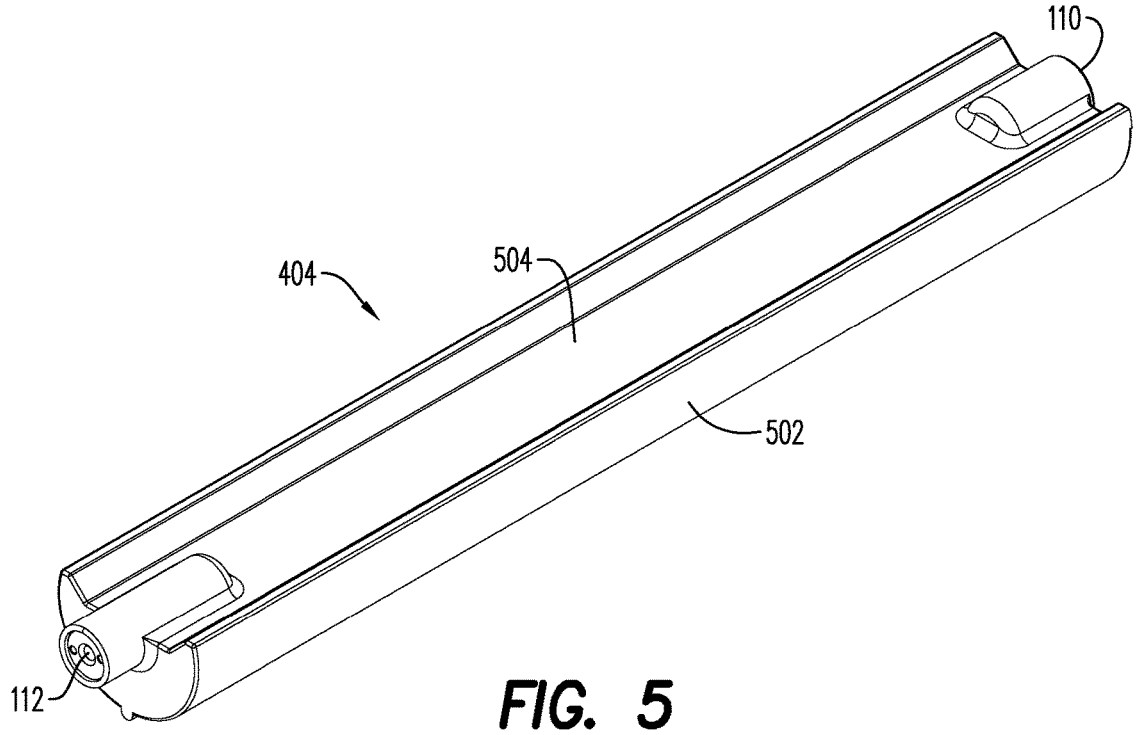
FIG. 5 is a perspective view of an eccentric weight module according to an exemplary embodiment.
Figure 6:
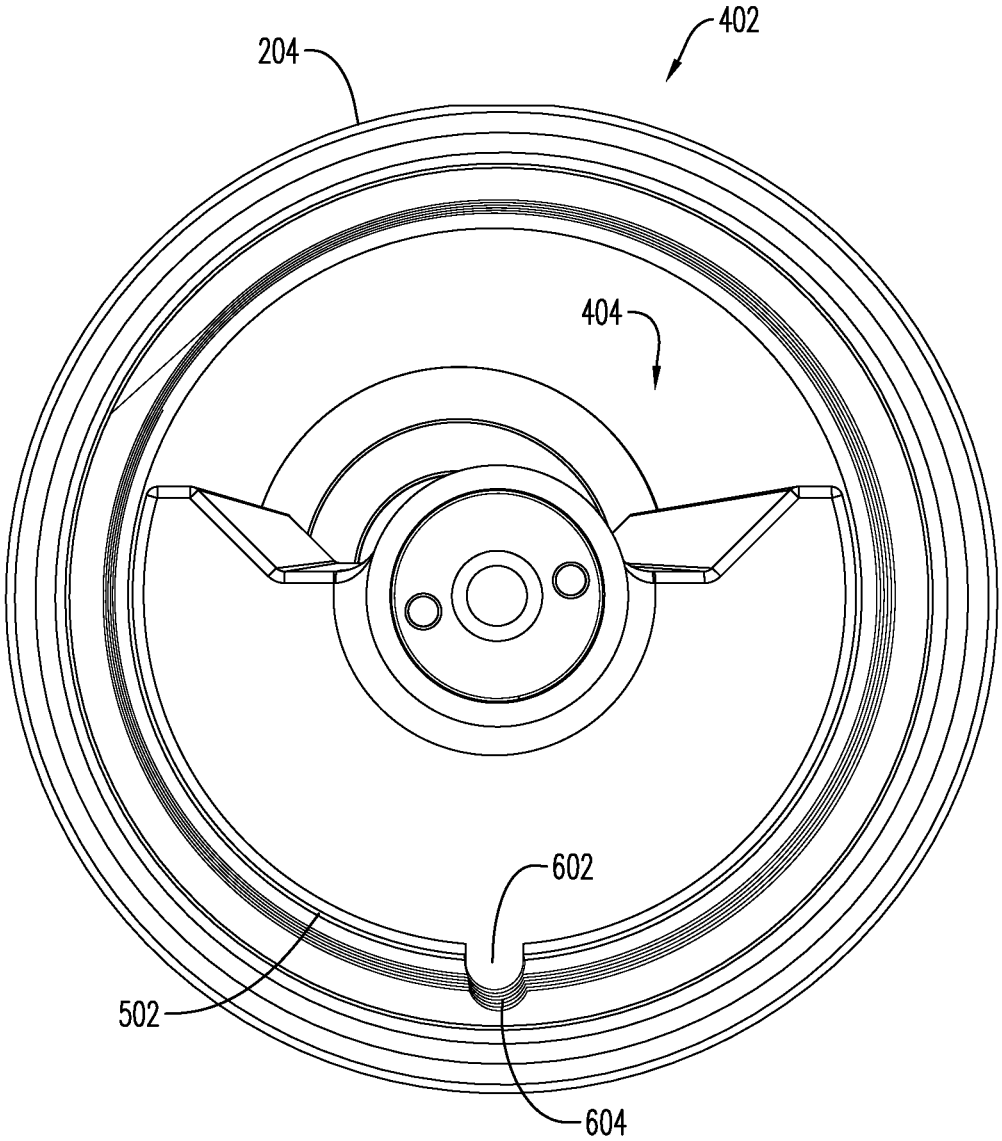
FIG. 6 is an end view of a weight module assembly according to an exemplary embodiment.

An exemplary embodiment will now be introduced according to FIGS. 4-6. The exemplary embodiment according to FIGS. 4-6 is illustrative and not limiting, and exemplary features may be referenced throughout this disclosure. FIG. 4 illustrates an exemplary eccentric weight module assembly 402 having an eccentric weight module 404 disposed within a weight module housing 204. In FIG. 4, the weight module housing 204 may be similar to those described with respect to FIGS. 2-3. For example, the weight module housing 204 may be a hollow cylinder. FIG. 5 illustrates an exemplary eccentric weight module 404. The eccentric weight module 404 may be similar to the weight module 102, for example having a conductive body 104 and an insulating cover 114, but may have an eccentric shape and/or weight distribution. In some embodiments, the eccentric weight module 404 may be configured to be eccentric with respect to the central axis 406 of the weight module housing 204. For example, the center of gravity of the eccentric weight module 404 may be radially offset from the central axis 406.

In some embodiment, the first contact portion 110 and second contact portion 112 (on opposite ends) of the eccentric weight module 404 may be configured to be disposed on the central axis 406 of the weight module housing 204. In some embodiments, the eccentric weight module 404 may be configured so that, when the eccentric weight module 404 is not vertically oriented, the force of gravity on the eccentric weight module 404 may rotate the eccentric weight module 404 about its longitudinal axis (e.g. so that a portion of the eccentric weight module 404 with more weight is oriented downward). In some embodiments, the eccentric weight module 404 may be configured so that, when in place in the weight module housing 204 and the TSA 208 is attached at ends, the TSA 208 holds the eccentric weight module 404 in place with the contact portions disposed on the central axis 406 of the weight module housing 204. For example, the TSA 208 may close the ends of the weight module housing 204 and/or may abut the eccentric weight module 404, preventing longitudinal movement of the eccentric weight module 404 within the weight module housing 204. In some embodiments, the electrical contacts of the TSA 208 may form a contact fit with the contact portions of the eccentric weight module 404, which may hold the contact portions (e.g. the first contact portion 110 and/or the second contact portion 112) approximately aligned with the central axis 406 of the weight module housing 204.

In some embodiments, the eccentric weight module 404 may be radially asymmetrical (e.g. not symmetrical about the central axis 406 and/or its longitudinal axis) in shape. In some embodiments, the eccentric weight module 404 may include a cylindrical surface portion 502 and a non-cylindrical surface portion 504. In some embodiments, the eccentric weight module 404 may be configured so that, when disposed in the weight module housing 204, an open space extends between the inward-facing surface (e.g. the non-cylindrical surface portion 504) of the eccentric weight module 404, and the weight module housing 204. In some embodiments, the open space may have a radial width approximately equal to that of the eccentric weight module 404 or the second region 410. (e.g. the distance between the cylindrical surface and the non-cylindrical surface). In some embodiments, the eccentric weight module 404 may be configured so that the gap between the eccentric weight module 404 and the weight module housing 204 is not uniform, for example with a larger gap on one side (e.g. between the inward-facing or non-cylindrical surface and the housing) than the other side (e.g. between the cylindrical surface and the housing). In some embodiments, the inward-facing surface of the eccentric weight module 404 may be the portion of the outer radial surface of the eccentric weight module 404 which is disposed closer to the longitudinal axis and/or the central axis 406.

In some embodiments, the conductive body 104 may comprise a first region 408 configured to extend along the central axis 406 (e.g. substantially coaxial with the housing when the eccentric weight module 404 is disposed within the weight module housing 204), and a second region 410 configured to be offset from the central axis 406 and adjacent the first region 408, with the center of gravity of the conductive body 104 displaced from the central axis 406. In some embodiments, the first region 408 may comprise or be formed by the rod piece(s). In some embodiments, the first region 408 may comprise a longitudinal axis which may be configured to be approximately coaxial with the central axis 406 of the weight module housing 204 when the eccentric weight module 404 is disposed within the weight module housing 204. In some embodiments, the center of gravity of the eccentric weight module 404 may be radially offset from the longitudinal axis of the rod piece(s) and/or the first region 408. In some embodiments, offset of the second region 410 may mean that a center of gravity of the second region 410 is radially displaced from the central axis 406 and/or from the longitudinal axis of the first region 408 (e.g. the rod pieces). In some embodiments, the second region 410 may be entirely or substantially located radially outward of the longitudinal axis of the first region 408.

In some embodiments, the second region 410 may comprise or be formed by the main body 106. In some embodiments, the outer radial surface of the eccentric weight module 404 may comprise a cylindrical surface portion 502 and a non-cylindrical surface portion 504. For example, the second region 410 may comprise an approximately half-cylinder main body 106 (e.g. longitudinally split), for example having the cylindrical surface portion 502 and the non-cylindrical surface portion 504. In some embodiments, the first region 408 and the second region 410 may be formed as a single integral piece of material, or alternatively may be formed of separate assembled parts as described above regarding the conductive body 104 (e.g. with one or more rod piece 108 attached to a main body 106).

While FIG. 5 shows the eccentric weight module 404 being asymmetrical in shape, in other embodiments the eccentric weight module 404 may be (approximately) symmetrical in shape about the central axis 406 and/or the longitudinal axis (e.g. cylindrical in shape, similar to FIG. 1), but may have a center of gravity which is offset (e.g. radially displaced) from the central axis 406 and/or longitudinal axis (e.g. weighted more to one side of the central axis 406 and/or longitudinal axis than to the opposite side). Some eccentric weight module 404 embodiments may be eccentric in weight distribution, even if symmetrical in shape.

FIG. 6 illustrates an exemplary eccentric weight module assembly 402. As shown in FIG. 6, the eccentric weight module 404 and/or the weight module housing 204 (e.g. jointly) may be configured to maintain a fixed angular relationship between the two structures (e.g. between the eccentric weight module 404 and the weight module housing 204). For example, the eccentric weight module assembly 402 may further comprise a rotation fixing mechanism configured to maintain a fixed angular relationship between the eccentric weight module 404 and the weight module housing 204. In the embodiment shown in FIG. 6, the rotation fixing mechanism comprises a key ridge 602 and a corresponding, complimentary key groove 604. For example, the key ridge 602 may be configured to slide into the key groove 604 longitudinally, and to then provide a rotational interference fit between the key ridge 602 and the key groove 604, such that rotation of the key ridge 602 (and the corresponding structure to which it is attached) drive s corresponding/equivalent rotation of the key groove 604 (and the corresponding structure to which it is attached). The rotational interference fit may act to maintain the fixed angular relationship between the eccentric weight module 404 and the weight module housing 204. In some embodiments, the key ridge 602 may be disposed on and extend outward from the outer radial surface of the eccentric weight module 404 (e.g. on the cylindrical surface portion 502 or second region 410), and the key groove 604 may be disposed on the interior surface of the weight module housing 204. For example, the key groove 604 may extend longitudinally on the interior surface of the weight module housing 204, approximately parallel to the central axis 406. The key ridge 602 may also extend longitudinally in the axial direction (e.g. parallel to the central axis 406).

The key ridge 602 may extend radially outward from the cylindrical surface portion 502. The key ridge 602 may align with and be inserted into the key groove 604 formed on an interior surface of the weight module housing 204. Thus, with the key ridge 602 inserted into the key groove 604, the eccentric weight module 404 of FIG. 6 is in a fixed angular relationship with the weight module housing 204. In other words, the eccentric weight module 404 cannot rotate within the weight module housing 204, and/or any rotation of the eccentric weight module 404 would result in corresponding rotation of the weight module housing 204. In alternative embodiments, the key groove 604 may be provided on the eccentric weight module 404 and the key ridge 602 may be provided on the interior surface of the weight module housing 204.

In some embodiments, the eccentric weight module assembly 402 may include an alignment TSA 412 (see for example FIG. 4) that allows the weight module housing 204 to be set in a known fixed angular relationship with an adjacent wellbore tool. For example, a convention may define that the position of the key ridge 602 in FIG. 6 is at 0 degrees. Knowing that the key ridge 602 is at 0 degrees, the alignment TSA 412 can be used to fix an adjacent perforating gun relative to the weight module housing 204 so that its shaped charges may be aimed at various pre-set angles, such as 0 degrees or 180 degrees, with respect to the key ridge 602. In some embodiments, the TSA 208 may comprise or be an alignment TSA 412.

Figure 7:
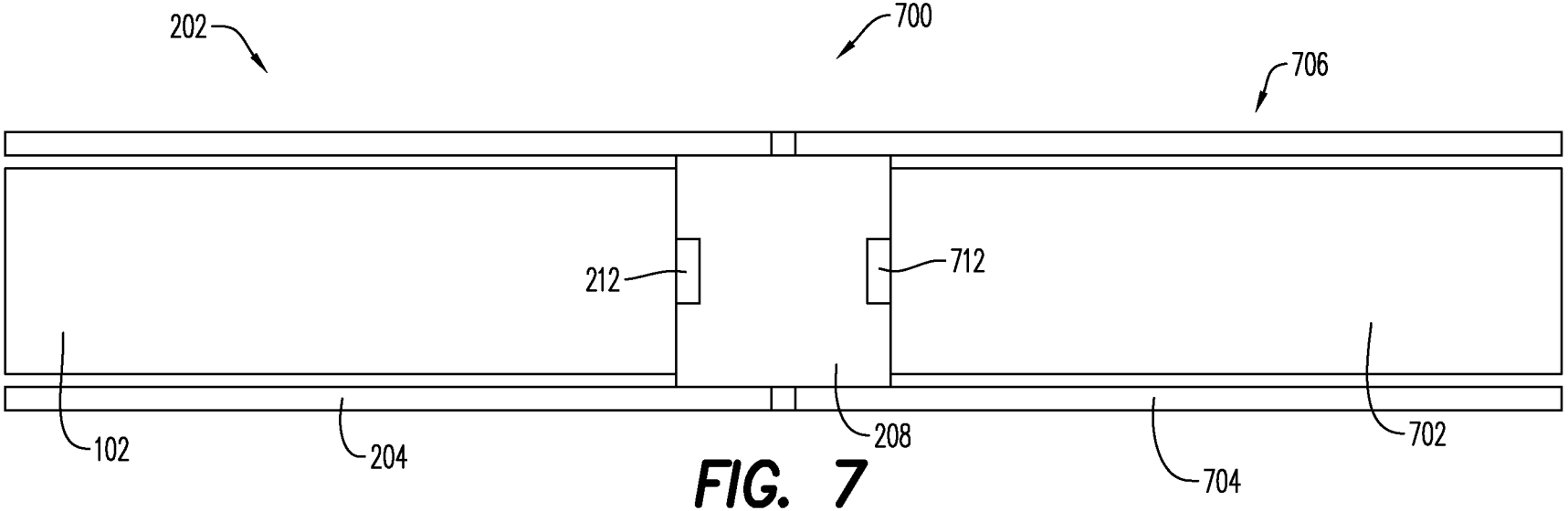
FIG. 7 is a schematic block view illustrating an exemplary wellbore tool string according to an exemplary embodiment.

In some embodiments, an alignment TSA 412 may be configured to be coupled between elements of a tool string and to allow for rotation of adjacent elements of the tool string. In some embodiments, the alignment TSA 412 may also allow for rotational position to be locked, thereby fixing the angular position of the adjacent elements of the tool string with respect to each other. This may allow for alignment of various elements of the tool string according to the specific needs of the project. For example, the alignment TSA 412 may comprise a first sub body part, a second sub body part, and a lock screw (or other rotational locking element). The first sub body part and the second sub body part may be rotatably coupled to each other, and the first sub body part and the second sub body part may be respectively non-rotatably coupled to a first element of the tool string (e.g. an eccentric weight module assembly 402) and a second element of the tool string (e.g. a perforating gun assembly 706). The lock screw or other locking element may fix the angular position of the first sub body part and the second sub body part, for example to fix alignment of elements of the tool string (such as the eccentric weight module assembly 402 and the perforating gun assembly 706, as shown in FIG. 7). Further description of exemplary embodiments of the alignment TSA 412 may be found in U.S. application Ser. No. 17/206,416 filed Mar. 19, 2021, which is hereby incorporated by reference in its entirety to the extent that it is consistent and/or compatible with this disclosure.

With this configuration (e.g. using an eccentric weight module 404 with an alignment TSA 412), the eccentric weight module assembly 402 can achieve a desired orientation of the perforating gun(s) within the wellbore. For example, in a wellbore with a horizontal component, the center of gravity of the eccentric weight module 404 can force the key ridge 602 toward a bottom surface of the wellbore through force of gravity. Because the eccentric weight module 404 is in a fixed angular relationship with the weight module housing 204, the gravitational force acting on the eccentric weight module 404 will cause the whole weight module assembly 402, and consequently, the tool string, to orient itself with the key ridge 602 facing the bottom of the wellbore. Accordingly, because the alignment TSA 412 allows for a perforating gun to be set in a known fixed angular relationship to the eccentric weight module assembly 402, the shaped charges of the perforating gun may be oriented in a desired direction within the wellbore. In some embodiments having multiple eccentric weight modules in a tool string, all of the eccentric weight modules may be oriented the same angular direction or orientation. In some embodiments, the one or more eccentric weight module 404 of the tool string may have sufficient weight to effectively rotate the entire tool string.

In an exemplary embodiment, the weight module 102 or the eccentric weight module 404 may be removable from the weight module housing 204. The weight module housing 204 may be configured to protect the weight module 102, 404 during usage of the tool string, and/or to provide additional weight. In this way, the weight module 102, 404 may be reusable, for example in case there is damage to the weight module housing 204. If the weight module housing 204 is damaged, the weight module 102, 404 may be removed from the damaged weight module housing 204 and placed within another, undamaged weight module housing 204.

In an exemplary embodiment, the weight module 102, 404 may have a weight of around 30 kg, and the length may be 20" or approximately 51 cm. However, it will be understood that the weight and length are not limited to these values and may be varied to suit particular applications.

An exemplary embodiment will now be introduced according to FIG. 7. The exemplary embodiment according to FIG. 7 is illustrative and not limiting, and exemplary features may be referenced throughout this disclosure. FIG. 7 shows an embodiment of a wellbore tool string 700 comprising a weight module assembly 202 and a perforating gun assembly 706. The weight module assembly 202 may be similar to embodiments described herein (including eccentric weight module assembly 402 embodiments), and the perforating gun assembly 706 may comprise a perforating gun 702 disposed within a perforating gun housing 704.

The perforating gun assembly 706 may typically include a perforating gun housing 704 or outer gun barrel containing or connected to perforating gun 702 internal components such as: an electrical wire for relaying an electrical control signal such as a detonation signal from the surface to electrical components of the perforating gun 702; an electrical, mechanical, and/or explosive initiator such as a percussion initiator, an igniter, and/or a detonator; a detonating cord; one or more explosive and/or ballistic charges which are held in an inner tube, strip, or other carrying device; and other known components including, for example, a booster, a sealing element, a positioning and/or retaining structure, a circuit board, and the like. The internal components may require assembly including connecting electrical components within the perforating gun housing 704 and confirming and maintaining the connections and relationships between internal components. Typical connections may include connecting the electrical relay wire to the detonator or the circuit board, coupling the detonator and the detonating cord and/or the booster, and positioning the detonating cord in a retainer at an initiation point of each charge.

The perforating gun housing 704 may also be connected at each end to a respective adjacent wellbore tool or other component of the tool string 700 such as a firing head and/or a tandem seal adapter or other sub assembly. Connecting the housing to the adjacent component(s) typically includes screwing the perforating gun housing 704 and the adjacent component(s) together via complementary threaded portions of the housing and the adjacent components and forming a connection and seal therebetween. In other embodiments, other types of connectors may be used to connect the perforating gun housing 704 to the adjacent component(s).

Known perforating guns may further include explosive charges, typically shaped, hollow, or projectile charges, which are initiated, e.g., by the detonating cord, to perforate holes in the casing of the wellbore and to blast through the formation so that the hydrocarbons can flow through the casing. In other operations, the charges may be used for penetrating just the casing, e.g., during abandonment operations that require pumping concrete into the space between the wellbore and the wellbore casing, destroying connections between components, severing a component, and the like. The exemplary embodiments in this disclosure may be applicable to any operation consistent with this disclosure. For purposes of this disclosure, the term "charge" and the phrase "shaped charge" may be used interchangeably and without limitation to a particular type of explosive, charge, or wellbore operation, unless expressly indicated.

The perforating gun assembly 706 may be utilized in and initial fracturing process or in a refracturing process. Refracturing serves to revive a previously abandoned well in order to optimize the oil and gas reserves that can be obtained from the well. In refracturing processes, a smaller diameter casing is installed and cemented in the previously perforated and accessed well. The perforating gun assembly 706 must fit within the interior diameter of the smaller diameter casing, and the shaped charges installed in the perforating gun 702 must also perforate through double layers of casing and cement combinations in order to access oil and gas reserves.

The explosive charges of the perforating gun 702 may be arranged and secured within the housing by the carrying device which may be, e.g., a typical hollow charge carrier or other holding device that receives and/or engages the shaped charge and maintains an orientation thereof. The carrier may be disposed within the perforating gun housing 704 in some embodiments, while in other embodiments the perforating gun housing 704 may comprise, consist essentially of, or form the carrier. Typically, the charges may be arranged in different phasing, such as 60°, 120°, 180°, etc. along the length of the charge carrier, so as to form, e.g., a helical pattern along the length of the charge carrier. Charge phasing generally refers to the radial distribution of charges throughout the perforating gun 702, or, in other words, the angular offset between respective radii along which successive charges in a charge string extend in a direction away from an axis of the charge string. An explosive end of each charge points outwardly along a corresponding radius to fire an explosive jet through the gun housing and wellbore casing, and/or into the surrounding rock formation. Phasing the charges therefore generates explosive jets in a number of different directions and patterns that may be variously desirable for particular applications. On the other hand, it may be beneficial to have each charge fire in the same radial direction. A charge string in which each charge fires in the same radial direction would have zero-degree (0°) phasing.

In some embodiments, the tool string 700 may comprise more than one perforating gun assembly 706. Once the perforating gun(s) is properly positioned, a surface signal (e.g. an electrical signal) can actuate an ignition of a fuse or detonator, which in turn initiates the detonating cord, which detonates the explosive charges to penetrate/perforate the perforating gun housing 704 and wellbore casing, and/or the surrounding rock formation to allow formation fluids to flow through the perforations thus formed and into a production string.

The weight module housing 204 may comprise an outer diameter similar to other tools configured for use in the wellbore tool string 700 and/or may be configured to allow insertion into a wellbore. The weight module housing 204 may have an inner diameter sufficiently large to encompass the weight module 102. In some embodiments, the weight module housing 204 may be identical in size and shape to the perforating gun housing 704. In some embodiments, a common, standardized housing may be used for both the weight module housing 204 and the perforating gun housing 704. In some embodiments, this configuration may allow for the weight module 102 (e.g. within the weight module housing 204) to be positioned at various locations along the tool string 700. For example, the weight module 102 may be positioned in proximity to the perforating gun 702.

While the weight module 102 often is removably/releasably disposed in the weight module housing 204 without attachment to the weight module housing 204, in other embodiments, the weight module 102 may be (e.g. removably) coupled to the weight module housing 204. In some embodiments, the weight module 102 may not be axially fixed to the weight module housing 204 (e.g. allowing axial movement of the weight module 102 within the weight housing), but the weight module 102 may be rotationally fixed with respect to the weight module housing 204. This configuration may allow the weight module 102 to be slidably removed from the weight module housing 204, while fixing the angular relationship between the weight module 102 and the weight module housing 204.

In some embodiments, the weight module housing 204 may comprise one or more coupling elements (e.g. threads) on each end (e.g. configured to allow attachment to a TSA 208, perforation gun, or other tool element within the tool string 700). For example, the threads on each end of the weight module housing 204 may be disposed on the interior surface of the weight module housing 204. Some embodiments of the tool string 700 may further comprise a tandem seal adapter (TSA 208) coupled to a first end of the weight module housing 204 (e.g. by threads). As discussed herein, the TSA 208 may have an electrical feedthrough assembly 210 having a first electrical contact 212, and the first electrical contact 212 of the electrical feedthrough assembly 210 may be in electrical contact with the first contact portion 110 of the conductive body 104 of the weight module 102. Some embodiments may further comprise a second TSA (not shown) coupled to a second end of the weight module housing 204, and the second TSA may have another electrical contact in electrical contact with the second contact portion 112 of the conductive body 104 of the weight module 102. In some embodiments, the TSA 208 may be an alignment TSA 412. In some embodiments, the TSA 208 or alignment TSA 412 may be disposed between the weight module 102 and the perforating gun 702, and may be configured to physically join/attach the weight module assembly 202 to the perforating gun assembly 706, and to electrically couple the weight module 102 to the perforating gun 702. For example, the TSA 208 may couple (e.g. by threaded connection) to the weight module housing 204 at one end and to the perforating gun housing 704 at the other end, and when coupled, the first electrical contact 212 of the TSA 208 may be electrically coupled (e.g. in electrical communication) with one of the contact portions of the weight module 102 and the second electrical contact 712 of the TSA 208 may be electrically coupled (e.g. in electrical communication) with the perforating gun 702. Thus, the TSA 208 may pass electrical signals between the weight module 102 and the perforating gun 702 or vice versa.

Some embodiments of the wellbore tool string 700 may have the perforating gun housing 704 coupled to the TSA 208, for example opposite the coupling of the TSA 208 to the weight module housing 204. In some embodiments, the weight module 102 and weight module housing 204 jointly have a substantially greater weight per linear/longitudinal unit of measurement (e.g. axial foot) than the perforating gun assembly 706 or the TSA 208 or the alignment TSA 412. For example, the weight module 102 may weigh at least about twice as much as the perforating gun 702, up to about twenty (20) times the weight of the perforating gun 702, or from about 2-20 times as much as the weight of the perforating gun 702, either on a per linear unit of measurement basis or as a whole, depending on the specific embodiment.

In some embodiments, the weight module 102 is configured to provide electrical connection between adjacent elements of the tool string 700 without external wires or wiring (e.g. wireless electrical connection), for example passing electrical signals from above the weight module 102 to below the weight module 102 within the tool string. For purposes of this disclosure, "wireless electrical connection" means an electrical connection formed by physical contact between conductive components, without any wires electrically connecting the conductive components. "Electrical contact" means either a conductive component for making a wireless electrical connection, or a state of physical, conductive contact between conductive components, as the context makes clear.

Aspects of the disclosure may include methods of forming and/or using a tool string. An exemplary method may comprise providing a weight module housing and a weight module, which may be similar to embodiments of the weight module and weight module housing described herein, and removably disposing the weight module within the weight module housing (e.g. to form the weight module assembly). For example, disposing the weight module within the weight module housing may comprise inserting (e.g. sliding) the weight module into the hollow interior of the weight module housing through one of the open ends. The insulating cover electrically isolates the weight module from the weight module housing, which may allow for effective transmission of electrical signals through the weight module. Typically, the first contact portion and the second contact portion of the weight module may be disposed approximately on the central axis of the weight module housing. In some embodiments, the weight module may be eccentric, and removably disposing the weight module within the weight module housing may further comprise fixing the angular relationship of the weight module with respect to the weight module housing. For example, the weight module may comprise a key ridge and the weight module housing may comprise a key groove, and fixing the angular relationship may comprise sliding the key ridge longitudinally within the key groove.

In some embodiments, the weight module housing may comprise releasable attachment mechanisms (e.g. threads) on each end, which may be configured for releasable attachment of the weight module housing to a TSA. The method may further comprise providing a TSA, and removably attaching the TSA to an end of the weight module housing. In some embodiments, removably attaching the TSA may further comprise electrically coupling the first electrical contact of the TSA to the first or second contact portion of the conductive body (e.g. in addition to physically coupling the TSA to the weight module housing).

Some embodiments may further comprise providing a perforating gun assembly, and removably attaching the perforating gun assembly to the TSA (e.g. via threaded connection) opposite the weight module housing (e.g. with the TSA located between the weight module housing and the perforating gun assembly). In some embodiments, providing the perforating gun assembly may further comprise disposing a perforating gun within a perforating gun housing. The perforating gun housing may be substantially identical to the weight module housing (e.g. so a TSA may be configured to couple to both the perforating gun housing and the weight module housing, for example using the same threads). In some embodiments, removably attaching the perforating gun assembly to the TSA electrically couples the perforating gun to the weight bar through the TSA. For example, electrical signals may pass through the weight module (e.g. conductive body), through the TSA, and to the perforating gun.

In some embodiments, the TSA may be an alignment TSA. Method embodiments may further comprise setting the angular relationship of the perforating gun relative to the weight module housing via the alignment TSA. Some embodiments may further comprise removably coupling the weight module housing to a second weight module housing (e.g. via threaded connection and/or TSA). In some embodiments, two or more weight modules may be attached within the tool string. For example, one or more TSA may be used to couple the weight module housing of multiple weight modules in series (e.g. longitudinally adjacent). In other embodiments, two or more weight modules may be distributed throughout the tool string, for example with one or more other tool element therebetween. In some embodiments, the weight module housing may be disposed anywhere along the length of the tool string (e.g. attached between any other elements, at multiple positions, or at any position of the tool string). For example, the TSA may be disposed in proximity to (e.g. longitudinally adjacent to) the perforating gun, a TSA (for example, which might be located between a perforating gun and the weight module), or other elements of the tool string. The weight module in the tool string may be configured to pass electrical signal through the weight module and between elements of the tool string (e.g. between elements disposed on opposite ends of the weight module, with the weight module being located between the elements).

Some method embodiments may further comprise detaching the weight module housing from the TSA, and removing (sliding) the weight module from the weight module housing. If the weight module housing has been damaged or worn or otherwise compromised, the method may further include disposing of the weight module housing, providing a second weight module housing, and/or (removably/releasably) disposing (e.g. sliding) the weight module into the second weight module housing. The second weight module housing may then be placed into the tool string (e.g. using TSA and/or threads), similar to the description above.

Some method embodiments may further comprise providing two TSA (which may be substantially similar), (removably) attaching (e.g. via threads) one of the two TSA to each end of the weight module housing, and electrically coupling each of the two TSA to the weight module (e.g. with the first TSA being electrically coupled to the first contact portion, and the second TSA being electrically coupled to the second contact portion). The weight module (e.g. conductive body) may electrically couple the first TSA to the second TSA (e.g. without external wire connection—for example by direct contact of the conductive body and the TSA electrical contacts). Some embodiments may further comprise attaching a first element of the tool string (e.g. such as a perforating gun) to either the first TSA or the second TSA (e.g. opposite the connection of the TSA to the weight module housing). Some embodiments may further comprise electrically coupling the first element to the weight module assembly (e.g. the weight module) through the TSA (e.g. without wiring). Some embodiments may further comprise attaching a second element of the tool string (e.g. such as a second perforating gun) to the remaining TSA (e.g. opposite the connection of the remaining TSA to the weight module housing). Some embodiments may further comprise electrically coupling the second element to the weight module assembly (e.g. the weight module) through the remaining TSA (e.g. without wiring).

Aspects of the disclosure may also include methods of manufacturing a weight module. An exemplary method may comprise the steps of providing a conductive body comprising high-density material, and applying an insulating cover to an outer radial surface of the conductive body, while ensuring that a first contact portion at a first end of the conductive body and a second contact portion at a second end of the conductive body are exposed (e.g. uncovered by the insulating cover). Typically, the insulating cover may be configured to electrically isolate the conductive body from a weight module housing. In some embodiments, the weight module and/or weight module housing may be similar to embodiments described herein. For example, the weight module may be configured to allow for insertion into the hollow interior of the weight module housing.

In some embodiments, providing the conductive body may comprise providing a main body of conductive material, providing a rod piece of conductive material, and coupling (e.g. physical attachment and electrical communication) the rod piece to an end of a main body to form the conductive body. In some embodiments, the rod piece may extend longitudinally outward from an end of the main body. In some embodiments, the main body may comprise or be formed of high-density material, for example with density at least as great as steel. In some embodiments, the rod piece may also comprise or be formed of high-density material. In some embodiments, the rod piece may comprise or be formed of a conductive material which has higher conductivity than the main body (e.g. the rod piece may have a higher conductivity than the main body). In some embodiments, the conductive body may be a solid, unitary continuous piece of high-density, conductive material. For example, the rod piece and the main body may be unitary and/or formed of a single solid piece of high-density, conductive material, for example with the rod piece being formed by shaping of the conductive body.

In some embodiments, the insulating cover may extend over an entire outer radial surface of the main body. In some embodiments, the insulating cover may also extend over an outer radial surface of the rod piece. In some method embodiments, providing the conductive body may further comprise providing a second rod piece of conductive material, and coupling the second rod piece to the end of the main body opposite the first rod piece, with the rod piece and the second rod piece in electrical communication through the main body.

In some embodiments, the weight module may be eccentric (for example, similar to eccentric embodiments described herein). For example, the step of providing the weight module may comprise forming an eccentric weight module configured to have a center of gravity radially displaced from a central axis of the weight module housing, while having first and second contact portions (on opposite ends) configured to be disposed on the central axis of the weight module housing. Some embodiments may further comprise providing a weight module housing, and removably disposing (e.g. sliding) the weight module within the weight module housing.

Some method embodiments may further comprise providing or forming a key ridge extending longitudinally on an outer radial surface of the weight module and/or providing or forming a key groove in the interior surface of the weight module housing. The key groove typically would be complementary to the key ridge and would allow axial movement of the weight module with respect to the weight module housing (e.g. for disposing the weight module within the weight module housing and/or removal of the weight module from the weight module housing) while restricting/fixing rotational movement (e.g. fixing the angular relationship between the weight module and the weight module housing). Some embodiments may have the key groove on the weight module and the key ridge on the weight module housing, but be otherwise similar. Some embodiments may further comprise providing or forming releasable attachment mechanisms (e.g. threads) in each end of the weight module housing. For example, one or both of the releasable attachment mechanisms may be configured for removably attachment of a TSA or other element of a wellbore tool string.

Exemplary embodiments of the weight module and weight module assembly as described above may result in significant advantages over conventional weight bar structures. For example, as discussed above, the modularity of the weight module assembly may allow it to be used at any point within the tool string, allowing greater flexibility for the user. Additionally, some embodiments of the weight modules may be used to help orient shaped charges in a desired direction within the wellbore. Further, the weight module assembly may use the same housing and TSAs used for coupling other tools within the tool string, thereby simplifying the manufacturing process. Weight module embodiments may also allow passage of electrical signals without the need for external wiring, which may simplify and improve the attachment process. Further, the configuration of the weight module assembly may protect the weight module and allow more effective reuse of the weight module.

This disclosure, in various embodiments, configurations and aspects, includes components, methods, processes, systems, and/or apparatuses as depicted and described herein, including various embodiments, sub-combinations, and subsets thereof. This disclosure contemplates, in various embodiments, configurations and aspects, the actual or optional use or inclusion of, e.g., components or processes as may be well-known or understood in the art and consistent with this disclosure though not depicted and/or described herein.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

In this specification and the claims that follow, reference will be made to a number of terms that have the following meanings. The terms "a" (or "an") and "the" refer to one or more of that entity, thereby including plural referents unless the context clearly dictates otherwise. As such, the terms "a" (or "an"), "one or more" and "at least one" can be used interchangeably herein. Furthermore, references to "one embodiment", "some embodiments", "an embodiment" and the like are not intended to be interpreted as excluding the existence of additional embodiments that also incorporate the recited features. Approximating language, as used herein throughout the specification and claims, may be applied to modify any quantitative representation that could permissibly vary without resulting in a change in the basic function to which it is related. Accordingly, a value modified by a term such as "about" or "approximately" is not to be limited to the precise value specified. Such approximating language may refer to the specific value and/or may include a range of values that may have the same impact or effect as understood by persons of ordinary skill in the art field. For example, approximating language may include a range of +/−10%, +/−5%, or +/−3%. The term "substantially" as used herein is used in the common way understood by persons of skill in the art field with regard to patents, and may in some instances function as approximating language. In some instances, the approximating language may correspond to the precision of an instrument for measuring the value. Terms such as "first," "second," "upper," "lower" etc. are used to identify one element from another, and unless otherwise specified are not meant to refer to a particular order or number of elements.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while considering that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

As used in the claims, the word "comprises" and its grammatical variants logically also subtend and include phrases of varying and differing extent such as for example, but not limited thereto, "consisting essentially of" and "consisting of." Where necessary, ranges have been supplied, and those ranges are inclusive of all sub-ranges therebetween. It is to be expected that the appended claims should cover variations in the ranges except where this disclosure makes clear the use of a particular range in certain embodiments.

The terms "determine", "calculate" and "compute," and variations thereof, as used herein, are used interchangeably and include any type of methodology, process, mathematical operation or technique.

This disclosure is presented for purposes of illustration and description. This disclosure is not limited to the form or forms disclosed herein. In the Detailed Description of this disclosure, for example, various features of some exemplary embodiments are grouped together to representatively describe those and other contemplated embodiments, configurations, and aspects, to the extent that including in this disclosure a description of every potential embodiment, variant, and combination of features is not feasible. Thus, the features of the disclosed embodiments, configurations, and aspects may be combined in alternate embodiments, configurations, and aspects not expressly discussed above. For example, the features recited in the following claims lie in less than all features of a single disclosed embodiment, configuration, or aspect. Thus, the following claims are hereby incorporated into this Detailed Description, with each claim standing on its own as a separate embodiment of this disclosure.

Advances in science and technology may provide variations that are not necessarily express in the terminology of this disclosure although the claims would not necessarily exclude these variations.

What is claimed is:

1. A weight module assembly for a wellbore tool, comprising:

a weight module housing having a hollow interior extending in an axial direction;

a weight module positioned in the hollow interior, the weight module including a first end, a second end, and a conductive body extending between the first end and the second end, wherein the conductive body has a center of gravity radially offset from a central axis of the housing, and the first end is configured for being in electrical communication with a first electrical contact of a first tool assembly, and the second end is configured for being in electrical communication with a second electrical contact of a second tool assembly.

2. The weight module assembly of claim 1, further comprising an insulating cover covering an outer radial surface of the conductive body.

3. The weight module assembly of claim 2, wherein the insulating cover is configured to electrically isolate the conductive body from the weight module housing.

4. The weight module assembly of claim 2, wherein the first end includes a first conductive portion, the second end includes a second conductive portion, and the insulating cover extends between the first conductive portion and the second conductive portion.

5. The weight module assembly of claim 1, further comprising:

a rotation fixing mechanism configured to rotationally fix the weight module and the weight module housing relative to one another or relative to the wellbore tool.

6. The weight module assembly of claim 5, wherein the rotation fixing mechanism includes:

a key ridge disposed on or extending outward from an outer radial surface of the conductive body, and a key groove formed in an interior surface of the weight module housing.

7. The weight module assembly of claim 5, wherein the rotation fixing mechanism includes:

a key ridge disposed on or extending outward from an outer radial surface of the weight module housing, and a key groove formed in an interior surface of the wellbore tool.

8. The weight module assembly of claim 7, wherein the rotation fixing mechanism is configured to hinder rotation of the weight module housing within the wellbore tool.

9. A wellbore tool, comprising:

a weight module housing having a hollow interior extending in an axial direction;

a weight bar positioned in the hollow interior, the weight bar including a first end, a second end, and a conductive body extending between the first end and the second end, the conductive body including a cylindrical surface portion and a non-cylindrical surface portion;

a first electrical contact in electrical communication with the first end; and a second electrical contact in electrical communication with the second end, wherein the first electrical contact is in electrical communication with the second electrical contact through the conductive body.

10. The wellbore tool of claim 9, wherein at least one of the first electrical contact or the second electrical contact includes a biasing member.

11. The wellbore tool of claim 9, wherein the conductive body comprises a main body and an extender coupled to the main body.

12. The wellbore tool of claim 11, wherein the extender forms the second end and is in electrical communication with the second electrical contact.

13. The wellbore tool of claim 12, wherein the extender is disposed along the central axis of the weight bar.

14. The wellbore tool of claim 13, wherein the conductive body has a center of gravity radially offset from a central axis of the housing.

15. The wellbore tool of claim 9, wherein the weight module housing is a tubular member configured for being coupled to adjacent wellbore tools.

16. The wellbore tool of claim 9, further comprising:

a rotation fixing mechanism including a key ridge and a key groove, wherein the key ridge is disposed on or extends outward from an outer radial surface of the conductive body, and the key groove is formed in an interior surface of the weight module housing; or the key ridge is disposed on or extends outward from an outer radial surface of the weight module housing, and the key groove is formed in an interior surface of the wellbore tool.

17. A wellbore tool string comprising:

a first wellbore tool comprising:

a first weight module housing having a hollow interior extending in a first axial direction, and a first eccentric weight bar positioned in the hollow interior of the first weight module housing, the first eccentric weight bar including a first end, a second end, and a first conductive body extending between the first end and the second end;

a second wellbore tool comprising:

a second weight module housing having a hollow interior extending in a second axial direction, and a second eccentric weight bar positioned in the hollow interior of the second weight module housing, the second eccentric weight bar including a first end, a second end, and a second conductive body extending between the first end and the second end of the second eccentric weight bar;

a tandem seal adapter (TSA) positioned in between and coupled to the first wellbore tool and the second wellbore tool, the TSA comprising:

an electrical feedthrough assembly having a first electrical contact and a second electrical contact, wherein the first electrical contact is in electrical communication with first end of the first eccentric weight bar, and the second electrical contact is in electrical communication with second end of the second eccentric weight bar.

18. The wellbore tool string of claim 17, wherein the TSA is an alignment TSA.

19. The wellbore tool string of claim 17, wherein at least one of the first wellbore tool or the second wellbore tool comprises:

a rotation fixing mechanism including a key ridge and a key groove, wherein:

the key ridge is disposed on or extends outward from an outer radial surface of the conductive body, and the key groove is formed in an interior surface of the weight module housing; or the key ridge is disposed on or extends outward from an outer radial surface of the weight module housing, and the key groove is formed in an interior surface of the wellbore tool.

20. The wellbore tool string of claim 17, further comprising:

a first insulating cover covering an outer radial surface of the conductive body of the first eccentric weight bar; and a second insulating cover covering an outer radial surface of the conductive body of the second eccentric weight bar.

* * * * *